US011666169B1

(12) United States Patent
Altmaier

(10) Patent No.: US 11,666,169 B1
(45) Date of Patent: Jun. 6, 2023

(54) PACKAGE RECEIVING DEVICE

(71) Applicant: Jeff Altmaier, Glendale, AZ (US)

(72) Inventor: Jeff Altmaier, Glendale, AZ (US)

( * ) Notice: Subject to any disclaimer, the term of this patent is extended or adjusted under 35 U.S.C. 154(b) by 5 days.

(21) Appl. No.: 17/583,268

(22) Filed: Jan. 25, 2022

(51) Int. Cl.
*A47G 29/20* (2006.01)

(52) U.S. Cl.
CPC ..... *A47G 29/20* (2013.01)

(58) Field of Classification Search
CPC ..... A47G 29/20; A47G 29/141; A47G 29/22; A47G 2029/144; B65D 7/26; B65D 9/14; B65D 15/24; B65D 11/1846; B65D 21/086
USPC ..... 232/19, 38, 45, 33; 220/6, 666
See application file for complete search history.

(56) References Cited

U.S. PATENT DOCUMENTS 922,181 A * 5/1909 Ohlson ..... A47G 29/12095 232/38
2,456,479 A * 12/1948 Antil ..... B65D 9/14 312/258
6,426,699 B1 * 7/2002 Porter ..... A47F 10/00 340/568.1
10,321,780 B1 * 6/2019 James ..... A47G 29/141
10,537,196 B1 * 1/2020 MacPherson ..... A47G 29/141
10,696,453 B2 * 6/2020 Sena ..... A47G 29/141
10,743,695 B1 * 8/2020 Altmaier ..... B60R 9/065
11,197,566 B2 * 12/2021 Aresu ..... A47G 29/124
11,246,443 B2 * 2/2022 Lin ..... A47G 29/141
11,278,144 B2 * 3/2022 Vernal Silva ..... A47G 29/141
11,510,517 B2 * 11/2022 McLean ..... B65D 11/1853
11,617,465 B2 * 4/2023 Zhang ..... A47G 29/141 232/38
2018/0296016 A1 * 10/2018 Teoh ..... A47G 29/20
2019/0225375 A1 * 7/2019 Sena ..... A47G 29/20
2019/0320836 A1 * 10/2019 Guanch ..... A47G 29/20
2021/0127880 A1 * 5/2021 Raphael ..... A47G 29/141
2022/0089317 A1 * 3/2022 Aliahmad ..... A47G 29/20
2022/0267048 A1 * 8/2022 Rogers ..... A47G 29/141

* cited by examiner

*Primary Examiner* — William L Miller
(74) *Attorney, Agent, or Firm* — Bruce A. Lev

(57) ABSTRACT

A package receiving device mountable to an exterior wall of a home or business structure that is collapsible into a flat stored configuration and expandable into a lockable package receiving receptacle having a rectangular volume adapted to temporarily store packages therein. Pivotable panels are adapted to allow the package receiving device to be moved between a stored configuration and expand into an in-use configuration.

10 Claims, 8 Drawing Sheets

PACKAGE RECEIVING DEVICE

CROSS-REFERENCE TO RELATED APPLICATION

There are no related applications incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

1. Field of the Invention

This invention relates generally to package receiving devices mountable to an exterior wall of a home or business structure that is collapsible into a flat stored configuration and expandable into a lockable package receiving receptacle having a rectangular volume adapted to temporarily store packages therein.

2. Description of the Related Art

Various package receiving devices have been developed over the years that are adapted to temporarily and securely store packages therein for retrieval by an addressee. However, the prior and related art are relatively bulky, heavy, complex, and expensive.

Accordingly, the present invention overcomes these disadvantages by providing an apparatus that is more compact, simpler, light weight, and lower cost.

BRIEF SUMMARY OF THE INVENTION

In view of the foregoing disadvantages inherent in the known types of package receiving devices the instant invention is set forth. As such, the general purpose of the present invention, which will be described subsequently in greater detail, is to provide a new and improved package receiving device with all the advantages of the prior art and none of the disadvantages.

It is an object of the present invention to provide an improved package receiving device that is more compact, simpler, lighter in weight, easier to use, and much lower in cost than the prior art.

In short, the instant package receiving device is adapted to be attached to a building wall, or a vehicle wall adjacent to a truck bed, and includes a frame and a series of pivotable panels attached to the frame designed and adapted to be stored against the frame in a collapsible configuration when not in-use and expandable into an in-use configuration forming a closable and lockable interior volume used to receive and securely and removably hold packages therein.

There has thus been outlined, rather broadly, the more important features of the invention in order that the detailed description thereof that follows may be better understood and in order that the present contribution to the art may be better appreciated.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

BRIEF DESCRIPTION OF THE DRAWINGS

The figures which accompany the written portion of this specification illustrate embodiments according to the teachings of the present invention.

Figure 1:
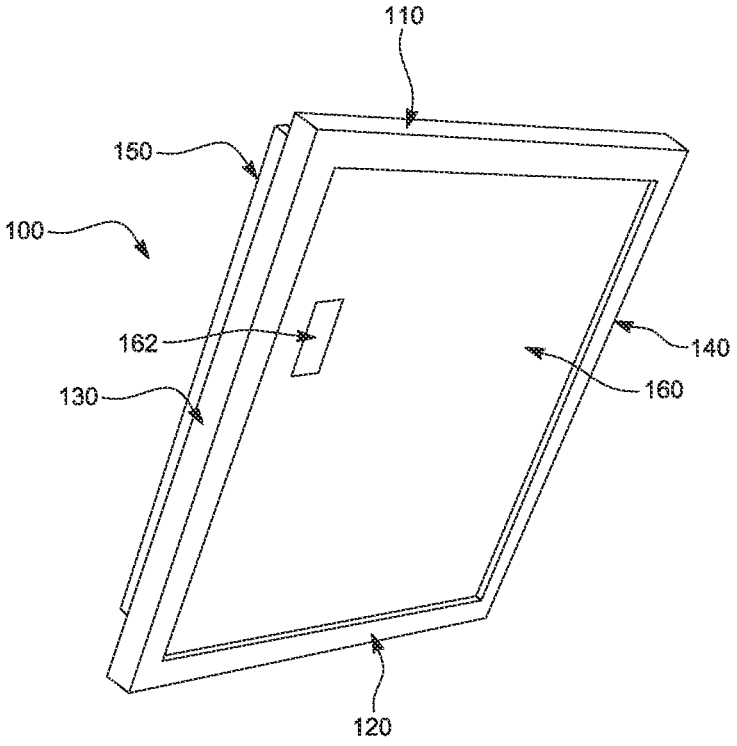
FIG. 1 shows a perspective view of the of the package receiving device in the stored configuration according to the preferred embodiment of the present invention.
Figure 2:
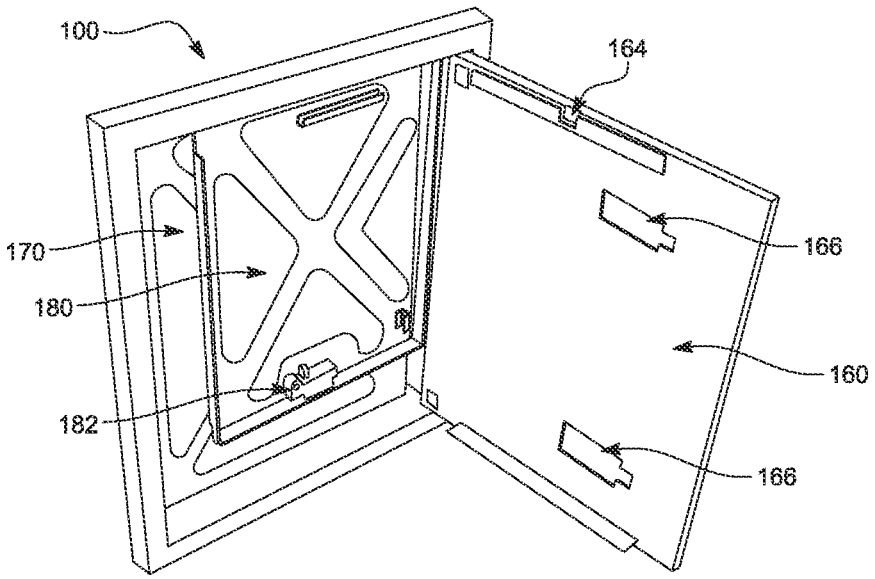
FIG. 2 shows a perspective view of the right side panel of the package receiving device being deployed into an in-use configuration according to the preferred embodiment of the present invention.
Figure 3:
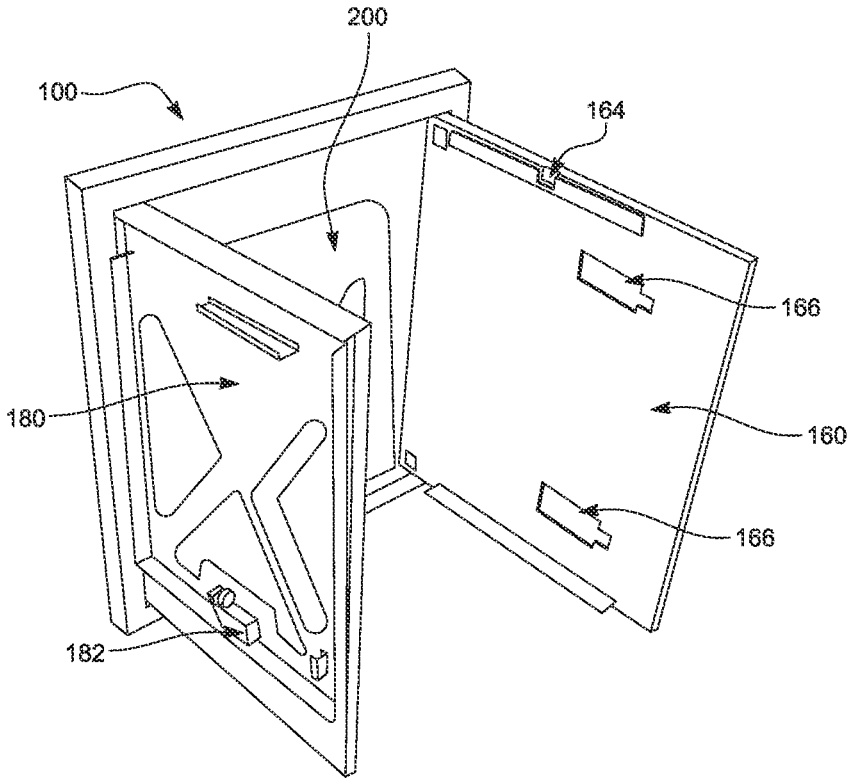
FIG. 3 shows another perspective view of the left side panel of the package receiving device being deployed into an in-use configuration according to the preferred embodiment of the present invention.
Figure 4:
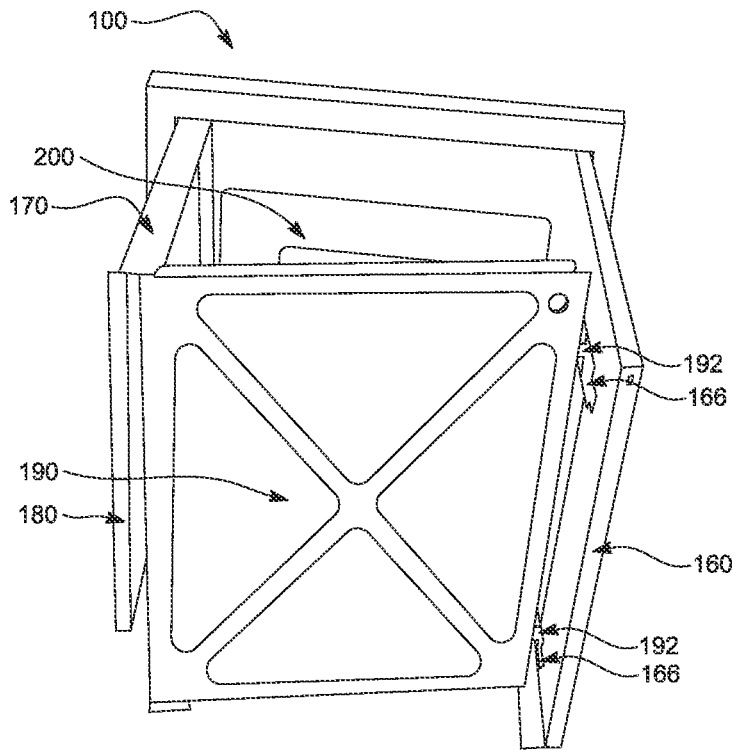
FIG. 4 shows a perspective view of the front panel of the package receiving device being deployed into an in-use configuration according to the preferred embodiment of the present invention.
Figure 5:
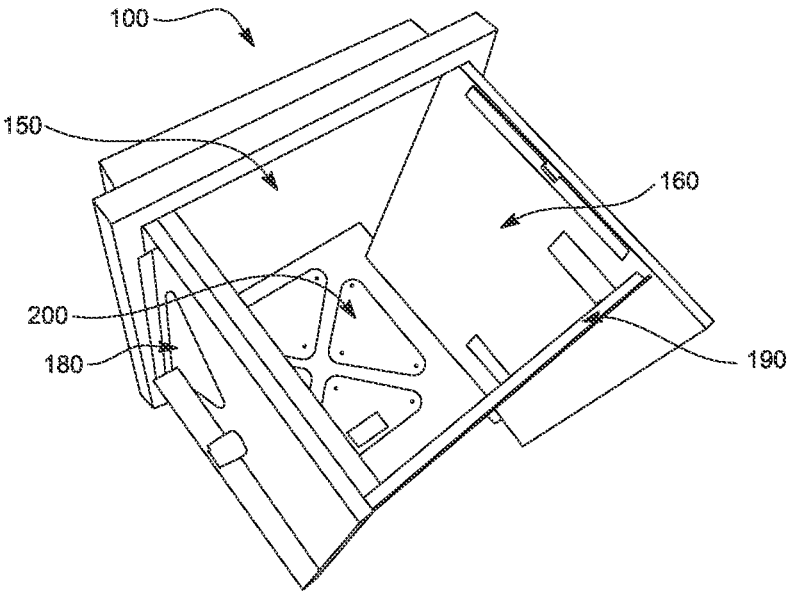
FIG. 5 shows a perspective view of the bottom panel of the package receiving device being deployed into an in-use configuration according to the preferred embodiment of the present invention.
Figure 6:
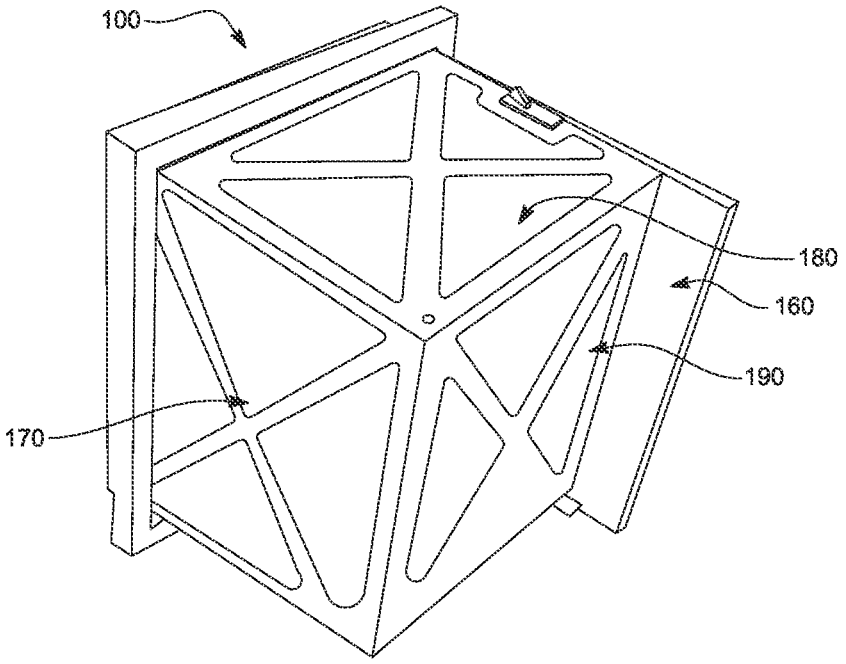
FIG. 6 shows a perspective view of the top panel of the package receiving device being deployed into an in-use configuration according to the preferred embodiment of the present invention.

The various embodiments of the present invention will hereinafter be described in conjunction with the appended drawings.

DETAILED DESCRIPTION

The embodiments of the present disclosure described below are not intended to be exhaustive or to limit the disclosure to the precise forms disclosed in the following detailed description. Rather, the embodiments are chosen and described so that others skilled in the art may appreciate and understand the principles and practices of the present disclosure.

The following embodiments and the accompanying drawings, which are incorporated into and form part of this disclosure, illustrate embodiments of the invention and together with the description, serve to explain the principles of the invention. To the accomplishment of the foregoing and related ends, certain illustrative aspects of the invention are described herein in connection with the following description and the annexed drawings. These aspects are indicative, however, of but a few of the various ways in which the principles of the invention can be employed and the subject invention is intended to include all such aspects and their equivalents. Other advantages and novel features of the invention will become apparent from the following detailed description of the invention when considered in conjunction with the drawings.

As illustrated in FIGS. 1-6, the present invention discloses a package receiving device 100 comprising a frame 200 including an elongated top cross member 110, an elongated bottom cross member 120, an elongated left side vertical member 130, and an elongated right side vertical member 140, wherein the elongated top cross member and the elongated bottom cross member are spaced from one another and extend substantially parallel to one another, wherein the elongated left side vertical member and the elongated right side vertical member are spaced from one another and extend substantially parallel to one another, and wherein respective end portions of the elongated top cross member, the elongated bottom cross member, the left side vertical member, and the right side vertical member are connected together to form a rectangular shape forming a center opening having a height and a width. The package receiving device 100 further comprises a back panel 150 connected between the top cross member, the elongated bottom cross member, the left side vertical member, and the right side vertical member; a right side panel 160 including a first locking member 162 located along a distal edge portion of the right side panel, wherein the first locking member is adapted to releasably lock with the frame, a first connector portion 164 located along a top edge portion of the right side panel, and at least one second connector portion 166 located on an inner surface of the right side panel, wherein the right side panel is pivotally connected to the elongated right side vertical member 140 at a proximal edge portion thereof, wherein the right side panel is formed having a height substantially equal to the height of the center opening of the frame, and wherein the right side panel is formed having a width substantially equal to the width of the center opening of the frame; a left side panel 170 pivotally connected to the elongated left side vertical member 130 at a proximal edge portion thereof, wherein the left side panel is formed having a height substantially equal to the height of the center opening of the frame, and wherein the left side panel is formed having a width less than the width of the center opening of the frame; a top panel including a second locking member 182 located along a distal edge portion of the top panel, and wherein the second locking member is adapted to releasably lock with the first connector portion 164 of the right side panel 160, wherein the top panel is pivotally connected to a top edge portion of the left side panel at a proximal edge portion thereof, wherein the top panel is formed having a length substantially equal to the width of the center opening of the frame, and wherein the top panel is formed having a width substantially equal to the width of the left side panel; a front panel 190 including at least one connector member 192 located along a distal edge portion of the front panel, and wherein the at least one connector member is adapted to releasably connect with the at least one second connector portion 166 of the right side panel, wherein the front panel is pivotally connected at a proximal side edge portion thereof to a distal edge portion of the left side panel opposite the proximal edge portion pivotally connected to said elongated left side vertical member of the frame, wherein the front panel is formed having a height substantially equal to the height of the center opening of the frame, and wherein the front panel is formed having a width less than the width of the center opening of the frame; and a bottom panel 200 pivotally connected to the elongated bottom cross member at an edge portion thereof, wherein the bottom panel is formed having a width less than the width of the center opening of the frame; wherein the right side panel, the left side panel, the front panel, the bottom panel, and the top panel are adapted to be pivoted into an in-use configuration forming a substantially rectangular volume; wherein the top panel is adapted to be removably locked via the second locking member and the first connector portion of the right side panel to securely and removably enclose the rectangular volume, such that when in the in-use configuration a package can be placed within the rectangular volume and locked therein until the first and second locking members are disengaged and the package removed from the rectangular volume; and wherein the package receiving device is adapted to be folded into a stored configuration that is relatively flat.

Furthermore, the elongated left side vertical member of the frame includes a latch connector thereon; and wherein the first locking member of the right side panel is formed as a latch upon adapted to releasably engage the latch connector of the elongated left side vertical member, such that the package receiving device can be securely held in the stored configuration.

Furthermore, the elongated top cross member, the elongated bottom cross member, the elongated left side vertical member, and the elongated right side vertical member of said frame are formed having a rectangular cross-section.

Furthermore, the bottom panel is pivotally connected to the elongated bottom cross member via at least one hinge member, wherein the left side panel is pivotally connected to the elongated left side vertical member via at least one hinge member, wherein the top panel is pivotally connected to the top edge portion of the left side panel via at least one hinge member, wherein the front panel is pivotally connected to the left side panel via at least one hinge member, and wherein the right side panel is pivotally connected to the elongated right side vertical member via at least one hinge member.

The package receiving device 100 may further comprise at least one wall connector adapted to securely connect the frame to a wall. The wall connector may be selected from a group consisting of screws, and nuts and bolts. The frame may be formed from a material selected from a group consisting of iron, steel, and aluminum. Furthermore, in the preferred embodiment the rectangular volume is between 2 and 3 feet in height, between 1 and 3 feet in width, and between 2 and 3 feet in length. Furthermore, the first locking member may include a pivoting handle attached thereto and formed and adapted to be locked and unlocked to the latch connector of the frame via a lock key. Furthermore, the at least one second connector portion of the right side panel are formed as rectangular apertures, and wherein the at least one connector member of the front panel are formed as T-shaped tabs, such that the T-shaped tabs are sized and adapted to be releasably placed within and connected with the rectangular apertures of the right side panel, to thereby releasably hold the front panel in the in-use configuration with said right side panel.

Figure 7:
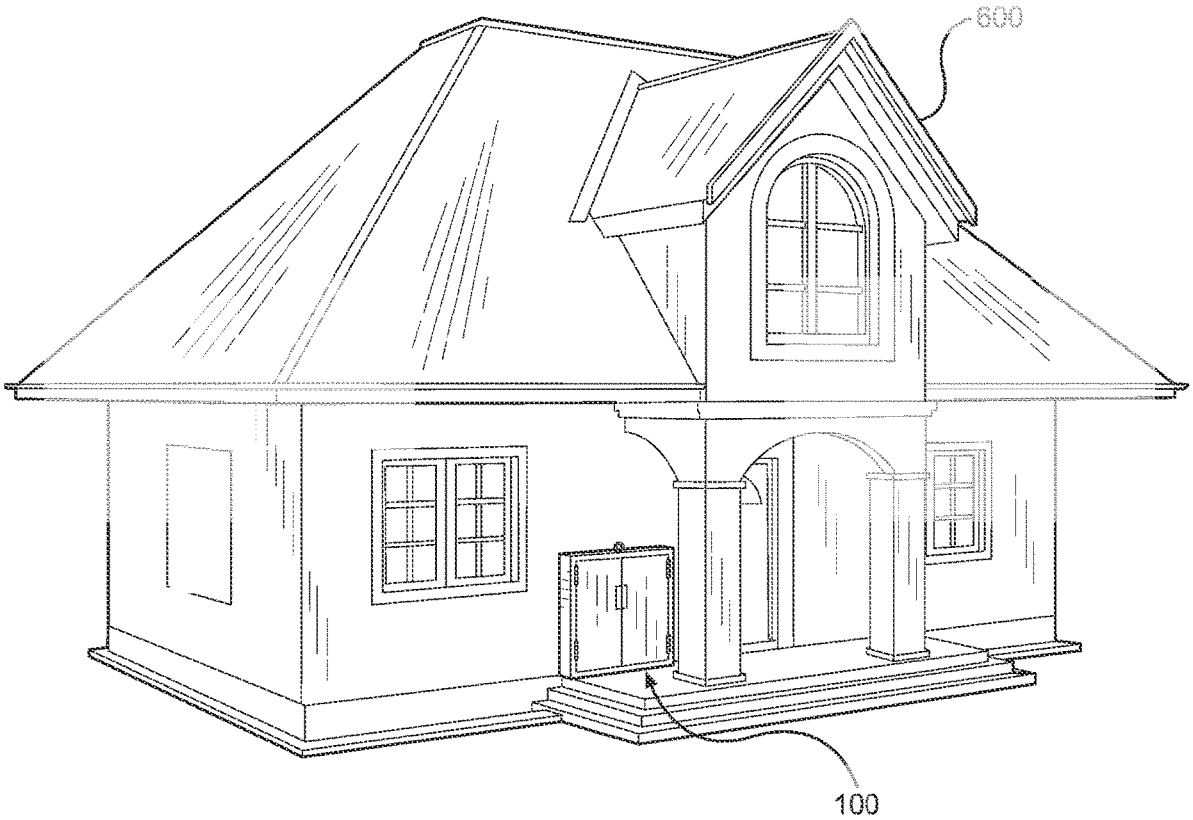
FIG. 7 shows a perspective view of the package receiving device attached upon the wall of a residential/business structure according to the preferred embodiment of the present invention.
Figure 8:
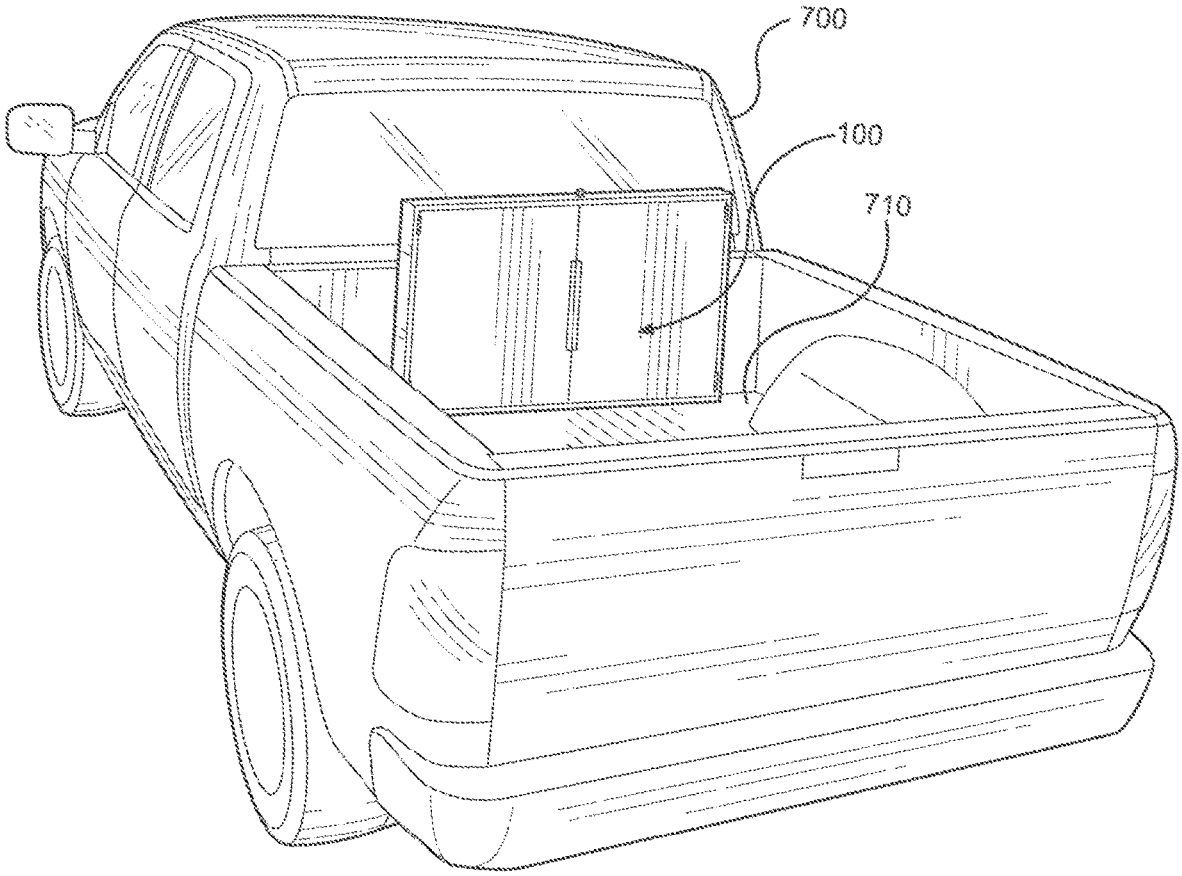
FIG. 8 shows a perspective view of the package receiving device attached upon the wall of a truck bed of a truck according to the preferred embodiment of the present invention.

The package receiving device 100 can be used in numerous environments. As shown in FIG. 7, the main use is upon and attached to the wall of a business or residential structure 600. As shown in FIG. 8, an alternative uses includes being attached within and upon the wall of a truck bed 710 of a truck 700.

Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the present invention.

Although the invention has been explained in relation to its preferred embodiment, it is to be understood that many other possible modifications and variations can be made without departing from the spirit and scope of the invention.

What is claimed is:

1. A package receiving device comprising:

a frame including:

an elongated top cross member;

an elongated bottom cross member;

an elongated left side vertical member; and an elongated right side vertical member;

wherein said elongated top cross member and said elongated bottom cross member are spaced from one another and extend substantially parallel to one another;

wherein said elongated left side vertical member and said elongated right side vertical member are spaced from one another and extend substantially parallel to one another; and wherein respective end portions of said elongated top cross member, said elongated bottom cross member, said left side vertical member, and said right side vertical member are connected together to form a rectangular shape forming a center opening having a height and a width;

a back panel;

wherein said back panel is connected between said top cross member, said elongated bottom cross member, said left side vertical member, and said right side vertical member;

a right side panel including:

a first locking member;

wherein said first locking member is located along a distal edge portion of said right side panel;

wherein said first locking member is adapted to releasably lock with said frame;

a first connector portion;

wherein said first connector portion is located along a top edge portion of said right side panel; and at least one second connector portion;

wherein said at least one second connector portion is located on an inner surface of said right side panel;

wherein said right side panel is pivotally connected to said elongated right side vertical member at a proximal edge portion thereof;

wherein said right side panel is formed having a height substantially equal to said height of said center opening of said frame; and wherein said right side panel is formed having a width substantially equal to said width of said center opening of said frame;

a left side panel;

wherein said left side panel is pivotally connected to said elongated left side vertical member at a proximal edge portion thereof;

wherein said left side panel is formed having a height substantially equal to said height of said center opening of said frame; and wherein said left side panel is formed having a width less than said width of said center opening of said frame;

a top panel including:

a second locking member;

wherein said second locking member is located along a distal edge portion of said top panel; and wherein said second locking member is adapted to releasably lock with said first connector portion of said right side panel;

wherein said top panel is pivotally connected to a top edge portion of said left side panel at a proximal edge portion thereof;

wherein said top panel is formed having a length substantially equal to said width of said center opening of said frame; and wherein said top panel is formed having a width substantially equal to said width of said left side panel;

a front panel including:

at least one connector member;

wherein said at least one connector member is located along a distal edge portion of said front panel; and wherein said at least one connector member is adapted to releasably connect with said at least one second connector portion of said right side panel;

wherein said front panel is pivotally connected at a proximal side edge portion thereof to a distal edge portion of said left side panel opposite said proximal edge portion pivotally connected to said elongated left side vertical member of said frame;

wherein said front panel is formed having a height substantially equal to said height of said center opening of said frame; and wherein said front panel is formed having a width less than said width of said center opening of said frame; and a bottom panel;

wherein said bottom panel is pivotally connected to said elongated bottom cross member at an edge portion thereof; and wherein said bottom panel is formed having a width less than said width of said center opening of said frame;

wherein said right side panel, said left side panel, said front panel, said bottom panel, and said top panel are adapted to be pivoted into an in-use configuration forming a substantially rectangular volume;

wherein said top panel is adapted to be removably locked via said second locking member and said first connector portion of said right side panel to securely and removably enclose said rectangular volume, such that when in said in-use configuration a package can be placed within said rectangular volume and locked therein until said first and second locking members are disengaged and the package removed from said rectangular volume; and wherein said package receiving device is adapted to be folded into a stored configuration that is relatively flat.

2. The package receiving device of claim 1, wherein said elongated left side vertical member of said frame includes a latch connector thereon; and wherein said first locking member of said right side panel is formed as a latch upon adapted to releasably engage said latch connector of said elongated left side vertical member, such that said package receiving device can be securely held in said stored configuration.

3. The package receiving device of claim 2, wherein said first locking member includes a pivoting handle attached thereto, and is formed and adapted to be locked and unlocked to said latch connector of said frame via a lock key.

4. The package receiving device of claim 1, wherein said elongated top cross member, said elongated bottom cross member, said elongated left side vertical member, and said elongated right side vertical member of said frame are formed having a rectangular cross-section.

5. The package receiving device of claim 1, wherein said bottom panel is pivotally connected to said elongated bottom cross member via at least one hinge member; wherein said left side panel is pivotally connected to said elongated left side vertical member via at least one hinge member; wherein said top panel is pivotally connected to said top edge portion of said left side panel via at least one hinge member; wherein said front panel is pivotally connected to said left side panel via at least one hinge member; and wherein said right side panel is pivotally connected to said elongated right side vertical member via at least one hinge member.

6. The package receiving device of claim 1, further comprising at least one wall connector adapted to securely connect said frame to a wall.

7. The package receiving device of claim 6, wherein said wall connector is selected from a group consisting of screws, and nuts and bolts.

8. The package receiving device of claim 1, wherein said frame is formed from a material selected from a group consisting of iron, steel, and aluminum.

9. The package receiving device of claim 1, wherein said rectangular volume is between 2 and 3 feet in height; between 1 and 3 feet in width; and between 2 and 3 feet in length.

10. The package receiving device of claim 1, wherein said at least one second connector portion of said right side panel is formed as a rectangular apertures; and wherein said at least one connector member of said front panel is formed as a T-shaped tabs, such that said T-shaped tabs is sized and adapted to be releasably placed within and connected with said rectangular apertures of said right side panel, to thereby releasably hold said front panel in said in-use configuration with said right side panel.

* * * * *